US007704330B2

(12) United States Patent
Rosenbauer

(10) Patent No.: US 7,704,330 B2
(45) **Date of Patent: *Apr. 27, 2010**

(54) METHOD FOR ADAPTING A RINSING PROGRAM IN A DISHWASHER MACHINE, AND CORRESPONDING DISHWASHER MACHINE

(75) Inventor: Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 83 days.

This patent is subject to a terminal disclaimer.

(21) Appl. No.: 11/043,462

(22) Filed: Jan. 26, 2005

(65) Prior Publication Data

US 2005/0126603 A1 Jun. 16, 2005

Related U.S. Application Data

(63) Continuation of application No. PCT/EP03/09243, filed on Aug. 20, 2003.

(30) Foreign Application Priority Data

Aug. 21, 2002 (DE) ..... 102 38 302

(51) Int. Cl.
*B08B 7/04* (2006.01)

(52) U.S. Cl. ..... 134/18; 134/25.2; 134/56 R; 134/57 D; 134/58 R; 134/58 D; 134/113

(58) Field of Classification Search ..... 134/18, 134/25.2, 56 D, 57 D, 58 D, 56 R, 113
See application file for complete search history.

(56) References Cited

U.S. PATENT DOCUMENTS

| | | | | |
|---|---|---|---|---|
| 5,806,541 | A * | 9/1998 | Cooper et al. | 134/57 D |
| 6,694,990 | B2 * | 2/2004 | Spanyer et al. | 134/57 D |
| 6,887,318 | B2 * | 5/2005 | Bashark | 134/18 |
| 2003/0079760 | A1 * | 5/2003 | Spanyer et al. | 134/18 |
| 2003/0213503 | A1 * | 11/2003 | Price et al. | 134/18 |
| 2003/0213505 | A1 * | 11/2003 | Price et al. | 134/25.2 |
| 2005/0224100 | A1 * | 10/2005 | Maunsell et al. | 134/56 D |

FOREIGN PATENT DOCUMENTS

| | | | |
|---|---|---|---|
| DE | 35 33 098 | A1 | 3/1987 |
| DE | 37 31 096 | C2 | 4/1989 |
| DE | 295 14 412 | U1 | 11/1995 |
| DE | 195 12 011 | A1 | 10/1996 |
| DE | 196 50 915 | A1 | 1/1998 |
| DE | 196 43 151 | A1 | 4/1998 |
| DE | 197 49 636 | A1 | 5/1999 |
| DE | 10220839 | A1 | 12/2003 |
| EP | 1002582 | A1 | 5/2000 |
| EP | 1 195 128 | A2 | 4/2002 |
| FR | 2 438 016 | | 4/1980 |
| GB | 2133975 | A | 8/1984 |

OTHER PUBLICATIONS

International Search Report.

* cited by examiner

*Primary Examiner*—Michael Barr
*Assistant Examiner*—Saeed T Chaudhry
(74) *Attorney, Agent, or Firm*—James E. Howard; Andre Pallapies

(57) ABSTRACT

A method for adapting a rinsing program in a dishwasher machine, and a dishwashing machine configured to perform the method, the method enabling the rinsing program run of a dishwasher machine to be adapted in such a way that satisfactory cleaning and drying performances are achieved even when using a combination rinse aid. To this end, the rinsing program run is adapted if there is insufficient salt, if the softening device is switched off, and if the dishwasher machine is on.

11 Claims, No Drawings

METHOD FOR ADAPTING A RINSING PROGRAM IN A DISHWASHER MACHINE, AND CORRESPONDING DISHWASHER MACHINE

The invention relates to a method for adapting a rinsing program in a dishwasher machine and a dishwasher machine for using this method.

In addition to the conventional use of dishwashing agent which is present in powder form and is inserted in a dishwashing agent dispensing device usually located in the door of a dishwasher machine and is dispensed by this at a pre-determined time and in addition to the use of liquid rinse aid which is also inserted in a dishwashing agent dispensing device usually located in the door of the dishwasher machine and is dispensed by this at a pre-determined time and in a pre-determined quantity, and in addition to the use of granular salt for softening the water that is poured into a special salt supply container of a softening device with an ion exchanger, agents in a tablet form or gel form of administration have been known for some time, which not only contain the actual dishwashing agent but also those components required as consumables during a rinsing phase. Thus, for example, combination products have been known for some time, so-called "3 in 1 tabs" or "3 in 1 gels" which in addition to the dishwashing agent, also contain the various dishwashing agent additives—the rinse aid and a chemical, which replaces the function of the softening device. According to the idea of the manufacturers of these tabs or gels, the respective components are used precisely at that time during the rinsing program run at which these components have their optimal effect.

When using tabs or gels with a corresponding chemical which replaces the function of the softening device, the disadvantage arises that the quantity of chemical located in the tabs or gels is not matched to all degrees of water hardness so that depending on the particular region, the use of tabs or gels either reduces the degree of hardness too much or does not sufficiently reduce the degree of hardness. In particular, the use of water having insufficiently reduced water hardness results in a lower efficiency of the dishwashing agent and the rinse aid and as a result, a substantially inferior cleaning and drying result is obtained.

As a consequence of this use of tabs or gels, the user of the dishwasher machine can detect that the cleaning performance and/or the drying performance is not satisfactory and in many cases causatively attributes this result to the dishwasher machine although the cause lies mainly in the use of tabs or gels.

The object of the present invention is thus to provide a method which allows the rinsing program run of a dishwasher machine to be adapted so that even when using a wide range of combination dishwashing agents, a satisfactory cleaning and drying performance is achieved.

This object is solved by the method according to the invention with the features according to claim 1 and by the dishwasher machine with the features according to the further independent claim. Advantageous further developments of the inventions are characterised in the dependent claims.

In the method for adapting a rinsing program in a dishwasher machine according to the invention, the rinsing program run is adapted if it is detected that there is a lack of salt and if a softening device is switched off and if the dishwasher machine is operating. By detecting the lack of salt in conjunction with a switched-off softening device and with the dishwasher machine operating, it can be established without any doubt that tabs or gels are being used, for which purpose an adaptation of the rinsing program without any intervention of the user is provided according to the invention to achieve a satisfactory cleaning and drying performance.

According to a preferred feature of the invention, during the rinsing program, the softening device, despite being switched off, is started up to soften the water and that if necessary, a lack-of-salt display is started up despite being switched off. As a result of using softened water for the cleaning and rinsing, which is thereby made possible, a better efficiency of these additives is achieved. The lack-of-salt display started up despite being switched off shows the user the special case in the cleaning action.

The present invention has succeeded in providing a method which allows the rinsing program run of a dishwasher machine to be adapted so that a satisfactory cleaning and drying performance is achieved even when using a wide range of combination dishwashing agents.

More appropriately, the lack of salt is detected by means of a level of salt in a salt supply container being too low. A sensor usually present in any case is thus used for a further advantageous measure.

According to an advantageous embodiment of the invention, the lack of salt is detected by means of a sensor to measure the properties of the corresponding rinsing solution. In addition to the higher degree of hardness, non-softened water also has a different pH to softened water. Thus, the sensor for measuring the properties of the rinsing solution is advantageously a pH sensor or a water hardness sensor.

With such a sensor the residual hardness of the filled water can naturally also be determined by a comparison with a pre-determined value. Thus, in a likewise especially advantageous fashion, if it is detected that there is a lack of salt during the rinsing program, the softening device, despite being switched off, is started up to soften the water to a minimum value in accordance with the detected pH and if necessary, a lack-of salt display is started up despite being switched off. Since it is known that the chemical contained in the tabs or gels, which should replace the function of the softening device, acts up to about 25° dH, the minimum degree of hardness according to the regulations is about 25° dH.

The aforesaid object is solved by a dishwasher machine according to the invention for using a method according to one of the preceding claims, wherein advantageously a pH sensor or a water hardness sensor is arranged to measure the properties of the rinsing solution.

The present invention has succeeded in providing a method which allows the rinsing program run of a dishwasher machine to be adapted so that even when a wide range of combination dishwashing agents are used, a satisfactory cleaning and drying performance is achieved.

The invention claimed is:

1. A method for producing a signal for adapting the rinsing program in a dishwasher machine, comprising:

producing a signal for adapting a rinsing program, the step of producing a signal including engaging at least one supplemental device within the dishwasher machine in response to a detection that there is an absence of salt above a predetermined minimum quantity, the softening device is switched off, and the dishwasher machine is operating, the step of engaging including commencing the operation of the softening device to soften the water.

2. The method of claim 1, wherein the adapting further comprises commencing an operation of a lack-of-salt display.

3. A method for producing a signal for adapting the rinsing program in a dishwasher machine, comprising:

producing a signal for adapting a rinsing program, the step of producing a signal including detecting via a selected one of a pH sensor and a water hardness sensor the absence of a salt in an associated supply container above a predetermined minimum quantity; engaging at least one supplemental device within the dishwasher machine in response to a detection that there is an absence of salt above a predetermined minimum quantity, the softening device is switched off, and the dishwasher machine is operating, the step of engaging including commencing the operation of the softening device to soften the water to a minimum value in accordance with the detected pH value and, optionally, commencing the operation of a lack-of-salt display despite it being switched off.

4. The method according to claim 3, wherein commencing the operation of the softening device to soften the water to a minimum value includes commencing the operation of the softening device to soften the water to a minimum hardness of about 25° dH.

5. A dishwasher comprising:

a controller that adapts a rinsing program of the dishwasher in response to an amount of salt being below a predetermined minimum quantity, a softener in an OFF condition, and the dishwasher operating, wherein the controller adapts the rinsing program by commanding the softener to operate.

6. The dishwasher of claim 5, wherein the controller adapts the rinsing program by commanding an operation of a lack-of-salt display.

7. The dishwasher of claim 5, further comprising a sensor that determines an amount of salt.

8. The dishwasher of claim 7, wherein the sensor determines an amount of salt in a supply container.

9. The dishwasher of claim 5 further comprising a sensor that detects a PH level.

10. The dishwasher of claim 5, further comprising a sensor that detects water hardness.

11. The dishwasher of claim 10, wherein the controller determines that the softener is in an OFF condition when the sensor detects a water hardness of about 25 dH.

* * * * *